US010124861B2

(12) United States Patent
Dubé

(10) Patent No.: US 10,124,861 B2
(45) Date of Patent: Nov. 13, 2018

(54) DETACHABLE HINGE FOR GLASS FRAME

(71) Applicant: VERALEX INC., Princeville (CA)

(72) Inventor: Simon Dubé, Rivière-du-loup (CA)

(73) Assignee: VERALEX INC., Princeville (CA)

( * ) Notice: Subject to any disclaimer, the term of this patent is extended or adjusted under 35 U.S.C. 154(b) by 0 days.

(21) Appl. No.: 15/700,752

(22) Filed: Sep. 11, 2017

(65) Prior Publication Data

US 2018/0072386 A1 Mar. 15, 2018

Related U.S. Application Data

(60) Provisional application No. 62/385,494, filed on Sep. 9, 2016.

(51) Int. Cl.

| | |
|---|---|
| ***B63B 19/02*** | (2006.01) |
| ***E05D 3/02*** | (2006.01) |
| ***E05D 5/12*** | (2006.01) |
| ***B63B 9/00*** | (2006.01) |
| ***E05D 7/10*** | (2006.01) |
| *B63B 19/00* | (2006.01) |

(52) U.S. Cl.

CPC ..... *B63B 19/02* (2013.01); *B63B 9/00* (2013.01); *E05D 3/02* (2013.01); *E05D 5/121* (2013.01); *E05D 5/128* (2013.01); *E05D 7/1005* (2013.01); *B63B 2019/0038* (2013.01); *E05D 2005/122* (2013.01); *E05D 2007/1033* (2013.01); *E05Y 2900/514* (2013.01)

(58) Field of Classification Search

CPC ..... B63B 19/02; B63B 9/00; E05D 3/02

USPC ..... 114/361

See application file for complete search history.

(56) References Cited

U.S. PATENT DOCUMENTS

| | | | | |
|---|---|---|---|---|
| 3,843,982 | A * | 10/1974 | Lane | B60J 1/06 114/361 |
| 5,203,277 | A | 4/1993 | Norman | |
| 5,309,860 | A * | 5/1994 | Shearer | E05D 5/10 114/361 |
| 5,329,667 | A | 7/1994 | Erskine | |
| 5,458,390 | A * | 10/1995 | Gilbert | B62J 17/00 296/102 |
| 5,505,156 | A | 4/1996 | Briggs | |
| 5,784,982 | A | 7/1998 | Erskine | |

(Continued)

*Primary Examiner* — S. Joseph Morano
*Assistant Examiner* — Jovon E Hayes
(74) *Attorney, Agent, or Firm* — Michael G. Johnston; Moore & Van Allen PLLC

(57) ABSTRACT

There is described a hinge for detachably connecting a door or window to a wall or a frame such as a windshield. The hinge comprising a shaft extending longitudinally, further comprising a blocker which is extendable about the shaft. A first socketed member is fixed to the shaft, and a second socketed member comprises a lumen for sliding the shaft therein. The lumen comprises a cavity larger than a remainder of the lumen and which defines an inward edge on which the blocker abuts, thereby retaining the shaft in the lumen. The shaft comprises an inner recess which can house the blocker therein if the inner recess is aligned with the blocker, thereby retracting the blocker from the cavity and releasing the shaft from the second socketed member and allowing the first socketed member and the second socketed member to be separated. This can be useful for detaching a door of a boat windshield, for example.

21 Claims, 13 Drawing Sheets

(56) References Cited

U.S. PATENT DOCUMENTS

| | | | | |
|---|---|---|---|---|
| 6,353,969 | B1 * | 3/2002 | Lemole | B60J 7/1204 114/361 |
| 6,386,789 | B1 | 5/2002 | Chausse et al. | |
| 6,637,363 | B2 | 10/2003 | Schmitt et al. | |
| 6,647,914 | B1 * | 11/2003 | Gerhardinger | B63B 19/02 114/361 |
| 7,144,061 | B1 * | 12/2006 | Behm | B60J 1/04 296/96.11 |
| 7,213,533 | B2 | 5/2007 | Gonzales | |
| 7,421,969 | B2 * | 9/2008 | Mercier | B63B 19/00 114/361 |
| 7,424,861 | B2 | 9/2008 | Mercier et al. | |
| 7,430,981 | B2 * | 10/2008 | Malcore | B63B 17/02 114/361 |
| 7,489,507 | B2 * | 2/2009 | Karashima | G06F 1/1616 16/221 |
| 7,653,969 | B2 * | 2/2010 | Erskine | E05D 7/00 16/269 |
| 7,661,747 | B2 * | 2/2010 | Erskine | B63B 17/02 296/84.1 |
| 7,845,304 | B2 | 12/2010 | Daniels et al. | |
| 8,201,516 | B2 | 6/2012 | Daneils | |
| 9,085,344 | B2 | 7/2015 | Dubé | |
| 2007/0186839 | A1 * | 8/2007 | Mercier | B63B 17/02 114/361 |
| 2014/0190391 | A1 * | 7/2014 | Dube | B63B 19/02 114/361 |
| 2018/0072386 | A1 * | 3/2018 | Dube | B63B 19/02 |

* cited by examiner

DETACHABLE HINGE FOR GLASS FRAME

CROSS REFERENCE TO RELATED APPLICATIONS

This application claims priority from U.S. Provisional Patent Application No. 62/385,494 filed on Sep. 9, 2016 the content of which is incorporated by reference in its entirety.

BACKGROUND

(a) Field

The subject matter disclosed generally relates to door hinges. More specifically, it relates to a detachable hinge for a glass frame.

(b) Related Prior Art

There exists in the market glass frames including one or more glass panels. Such frames are often provided as walls or wall extensions in buildings, or as stand-alone structures such as windshields for boats or the like.

These glass frames are often configured to include one or more glass panels that open and close defining door or window structures. These door or window structures are hingedly connected to a wall or a portion thereof. However, these door or window structures, once opened, either remain open, and thus, remain subject to moving between the closed position and the open position with the wind and other factors, or they lock in a completely opened position overlapping one or more adjacent glass panels, thereby reducing the visibility for those who look through the glass panels.

A non-limiting example of the applications of such doors is in the boat manufacturing business. There currently exist boat windshields which include doors that open and close. These doors are sometimes configured to be locked in a completely open position where the door overlaps the stationary (non-moving) portions of the windshield. However, this configuration greatly limits the visibility of the sailor since the glass through which the person is expected to look is doubled.

Moreover, even when the door is locked in the open position, it usually stays loosely locked and keeps some mobility. For example, it can wobble or even flap on the wall under the effect of wind or movement of the underlying object on which the door is installed (e.g., boat).

Therefore, there is a need for a door assembly system which allows for safely and easily removing the door and storing it away while being able to easily re-install it when needed.

As will be realized, the subject matter disclosed and claimed is capable of modifications in various respects, all without departing from the scope of the claims. Accordingly, the drawings and the description are to be regarded as illustrative in nature, and not as restrictive and the full scope of the subject matter is set forth in the claims.

SUMMARY

According to an aspect of the invention, there is provided a boat windshield comprising:

a first stationary panel; a removable door, the first stationary panel and the removable door together forming at least a portion of the boat windshield; and a hinge making the removable door hingeable with respect to first stationary panel and comprising:

a first socketed member fixed to any one of the first stationary panel and the removable door, and a second socketed member fixed to another one of the first stationary panel and the removable door; and a shaft extending longitudinally, fixed to the first socketed member and slidable into the second socketed member, further comprising a blocker which is extendable about the shaft to act as a longitudinal lock of the shaft in the second socketed member.

According to an embodiment, there is further provided a second stationary panel, the removable door being provided between the first stationary panel and the second stationary panel and having an edge flush with the second stationary panel such as to have the first and second stationary panels and the removable door together form at least a portion of the boat windshield.

According to an embodiment, the first and second stationary panels and the removable door are transparent panels.

According to an embodiment, the second socketed member comprises a lumen for sliding the shaft therein, the lumen comprising a cavity larger than a remainder of the lumen and which defines an inward edge on which the blocker abuts, thereby retaining the shaft in the lumen.

According to an embodiment, the shaft comprises an inner recess which can house the blocker therein if the inner recess is aligned with the blocker, thereby retracting the blocker from the cavity and releasing the shaft from the second socketed member.

According to an embodiment, the shaft comprises a core and a jacket around the core which is slidable with respect to the core, both extending longitudinally, further comprising a blocker which is extendable about the shaft and housed in the jacket.

According to an embodiment, there is further provided a button to which the core is secured, the button being pushable by a user to slide the core with respect to the jacket.

According to an embodiment, there is further provided a biasing means to urge the button back to an original position when the button is not being pushed by a user.

According to an embodiment, the core has a recess therein which, upon sliding the core with respect to the jacket, reaches a location where the blocker is housed in the jacket, the blocker retracting into the recess, thereby moving the blocker away from the inward edge, releasing the shaft from the second socketed member and allowing the first socketed member and the second socketed member to be separated.

According to an embodiment, the recess if formed on a surface of the core by an inwardly tapered shape of the core.

According to another aspect of the invention, there is provided a hinge for making a door hingeable and removable with respect to a stationary panel, the hinge comprising:

a shaft extending longitudinally, further comprising a blocker which is extendable about the shaft;

a first socketed member fixed to the shaft;

a second socketed member comprising a lumen for sliding the shaft therein, the lumen comprising a cavity larger than a remainder of the lumen and which defines an inward edge on which the blocker abuts, thereby retaining the shaft in the lumen.

wherein the shaft comprising an inner recess which can house the blocker therein if the inner recess is aligned with the blocker, thereby retracting the blocker from the cavity and releasing the shaft from the second socketed member.

According to an embodiment, the first socketed member is to be attached to the door and the second socketed member is to be attached to the stationary panel, the hinge providing hingeable movement between the door and the stationary panel, and removability of the door with respect to the stationary panel.

According to an embodiment, the door and the stationary panel form at least a portion of a boat windshield.

According to another aspect of the invention, there is provided a method of detaching a hinged door that is both hingeable and removable with respect to a stationary panel, the method comprising:

providing a shaft extending longitudinally, the shaft comprising a blocker which is extended about the shaft, the shaft having a first portion thereof, away from the blocker, secured to a first socketed member which is itself secured to any one of the door and the stationary panel, and a second portion thereof, comprising the blocker, housed within a lumen of a second socketed member, the lumen comprising a cavity larger than a remainder of the lumen and which defines an inward edge on which the blocker abuts, thereby retaining the shaft in the lumen;

moving the shaft longitudinally until an inner recess within the shaft is aligned with the blocker, such that the blocker retracts thereinto, thereby retracting the blocker from the cavity and releasing the shaft from the second socketed member such as to detach the door from the stationary panel.

According to an embodiment, the door and the stationary panel form at least a portion of a boat windshield.

According to an embodiment, there is further provided providing the door at a position by the stationary panel such that an edge of the door away from the stationary panel ends flush with a second stationary panel such as to form the boat windshield.

According to an embodiment, there is further provided, upon releasing the shaft from the second socketed member, completely detaching the door from the stationary panel.

According to an embodiment, moving the shaft longitudinally comprises pushing on a button at an end of the shaft to push the shaft longitudinally in a direction contrary to the end of the shaft.

According to an embodiment, the shaft is secured to the first socketed member by a jacket of the shaft, wherein the shaft further comprises a core housed within the jacket, wherein moving the shaft longitudinally comprises moving the core longitudinally with respect to the jacket.

According to an embodiment, the inner recess is provided on a surface of the core, wherein upon moving the shaft longitudinally, the core has its inner recess aligned with the blocker to allow the blocker to retract thereinto.

According to an embodiment, there is further provided urging the button back to an original position using a biasing means when the button is not being pushed by a user.

As will be realized, the subject matter disclosed and claimed is capable of modifications in various respects, all without departing from the scope of the claims. Accordingly, the drawings and the description are to be regarded as illustrative in nature, and not as restrictive and the full scope of the subject matter is set forth in the claims.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

Figure 1:
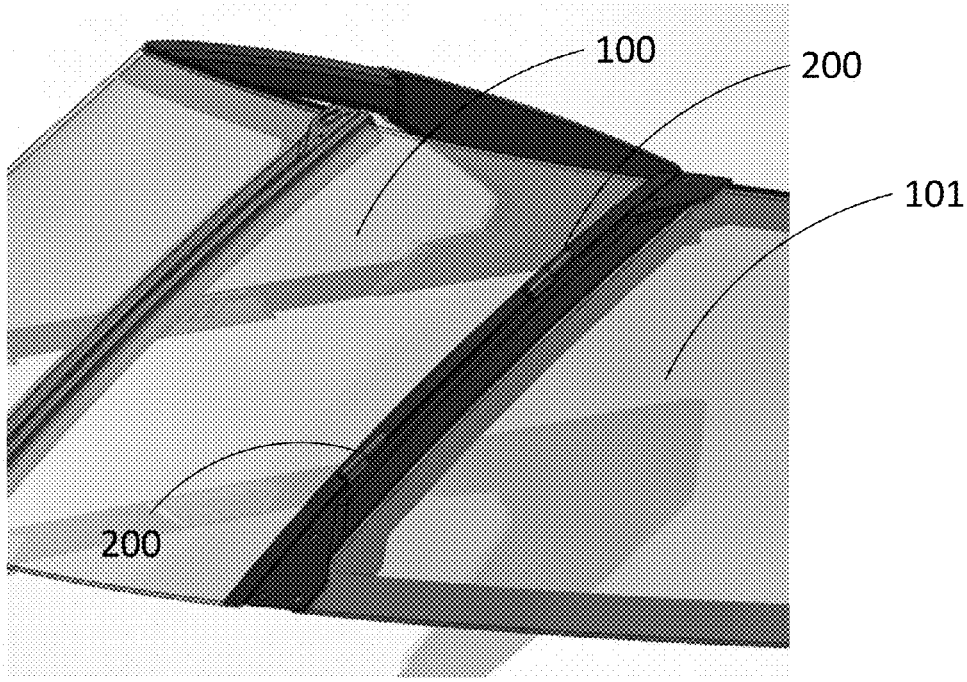
FIG. 1 is a perspective view illustrating a glass door hingedly connected to a glass wall, according to an embodiment.
Figure 2:
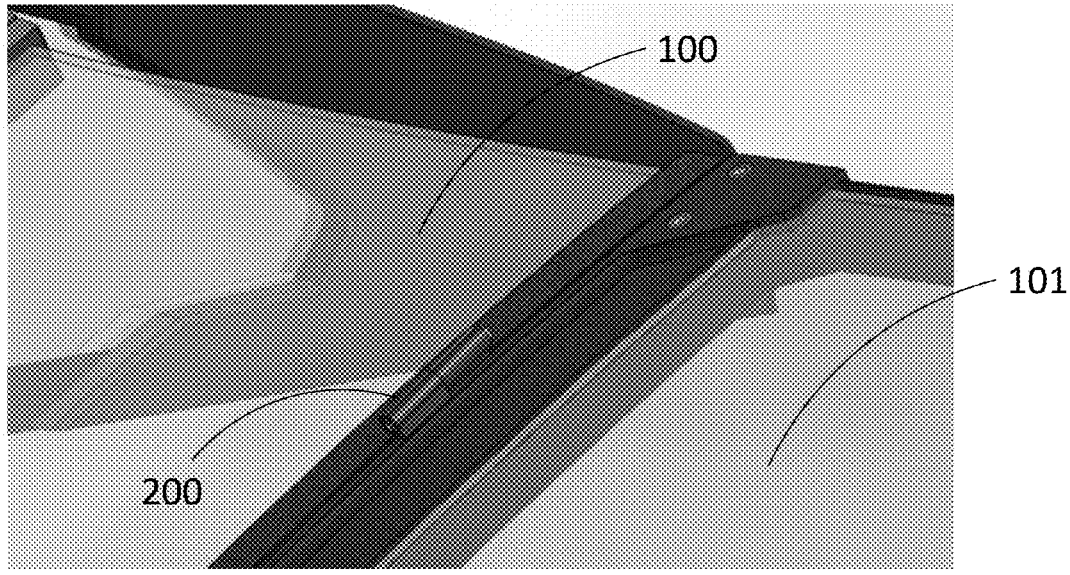
FIG. 2 is a close-up view of FIG. 1.
Figure 3:
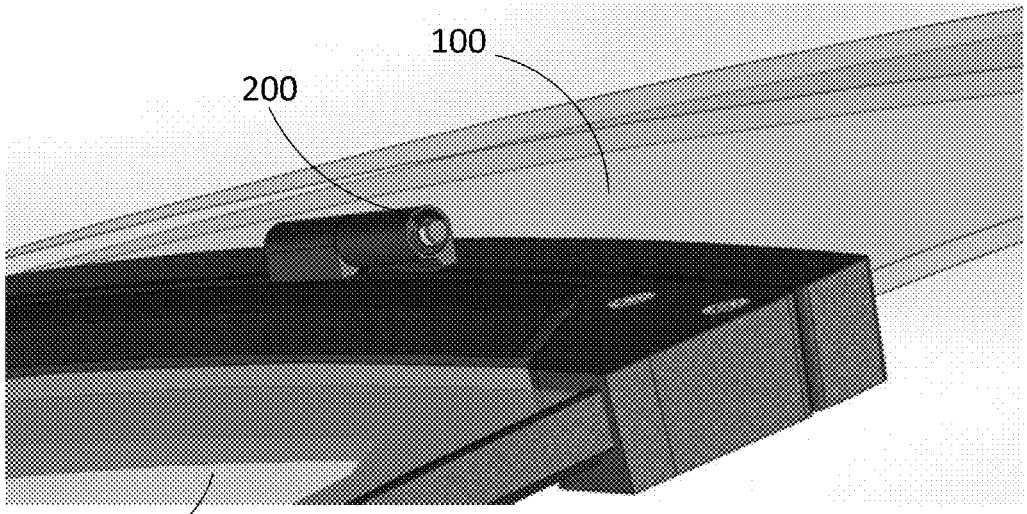
FIG. 3 is a perspective view of a hinge connection between a door and a wall, according to an embodiment.
Figure 4:
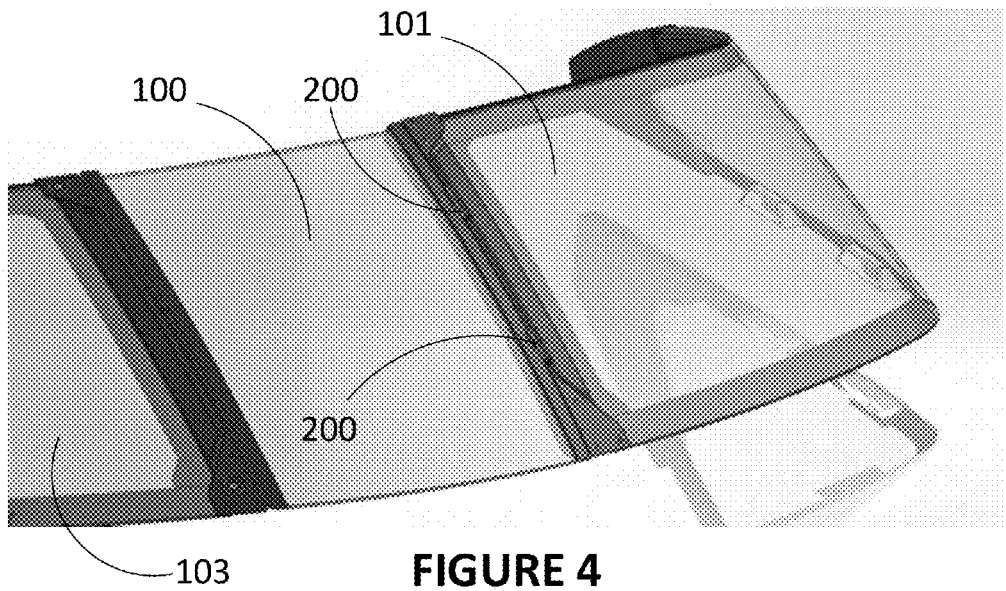
FIG. 4 is a perspective view illustrating a boat windshield door hingedly connected to the glass frame forming the windshield, according to an embodiment.
Figure 5:
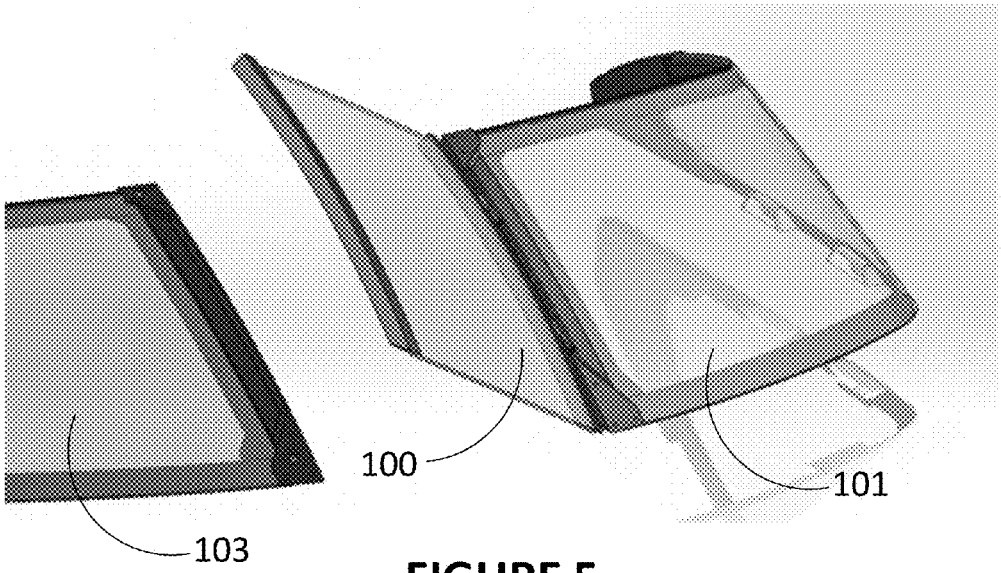
FIG. 5 is a perspective view illustrating the door of FIG. 4 in an open position, according to an embodiment.
Figure 6:
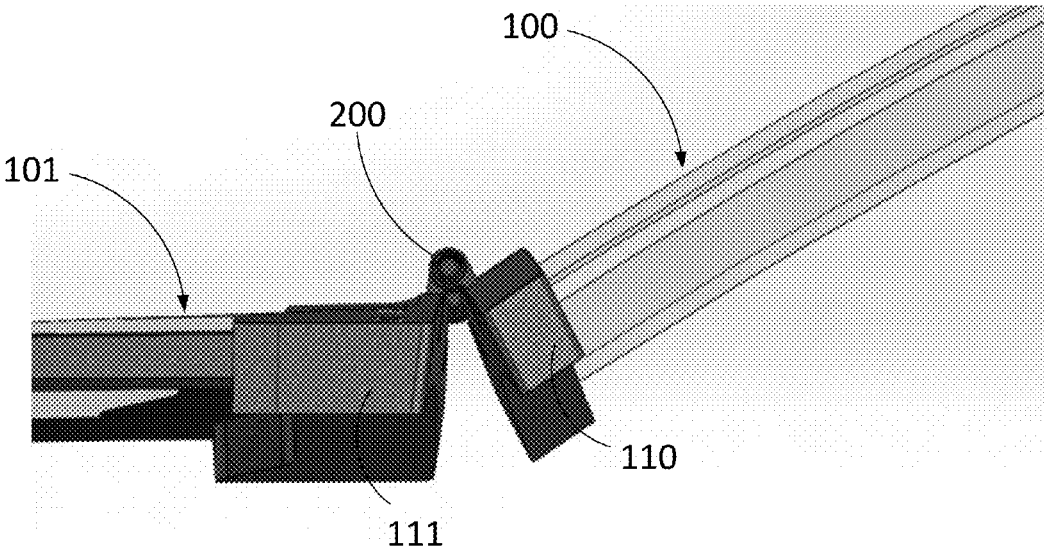
FIG. 6 is a top view illustrating the hinge connection between the door being opened with respect to the wall, according to an embodiment.
Figure 7:
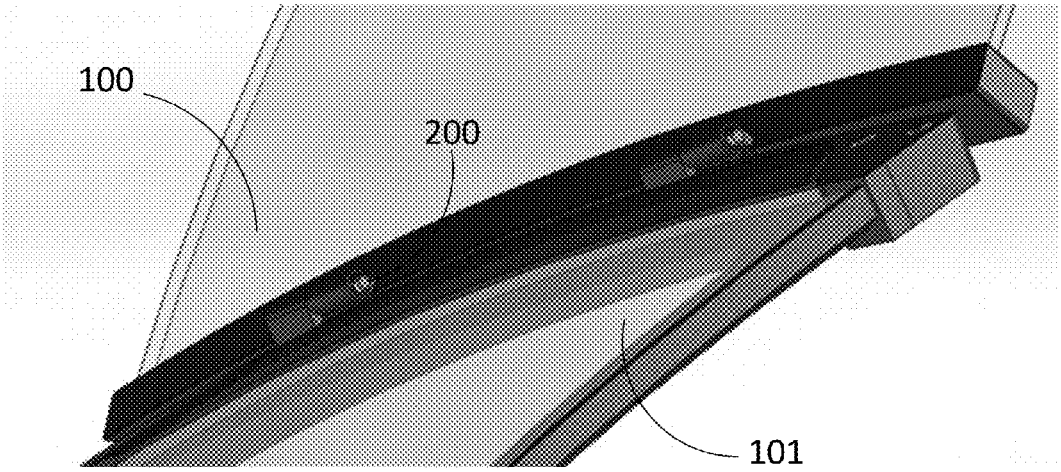
FIGS. 7-9 are perspective views illustrating the hinge connection between the door being opened with respect to the wall, according to an embodiment.
Figure 8:
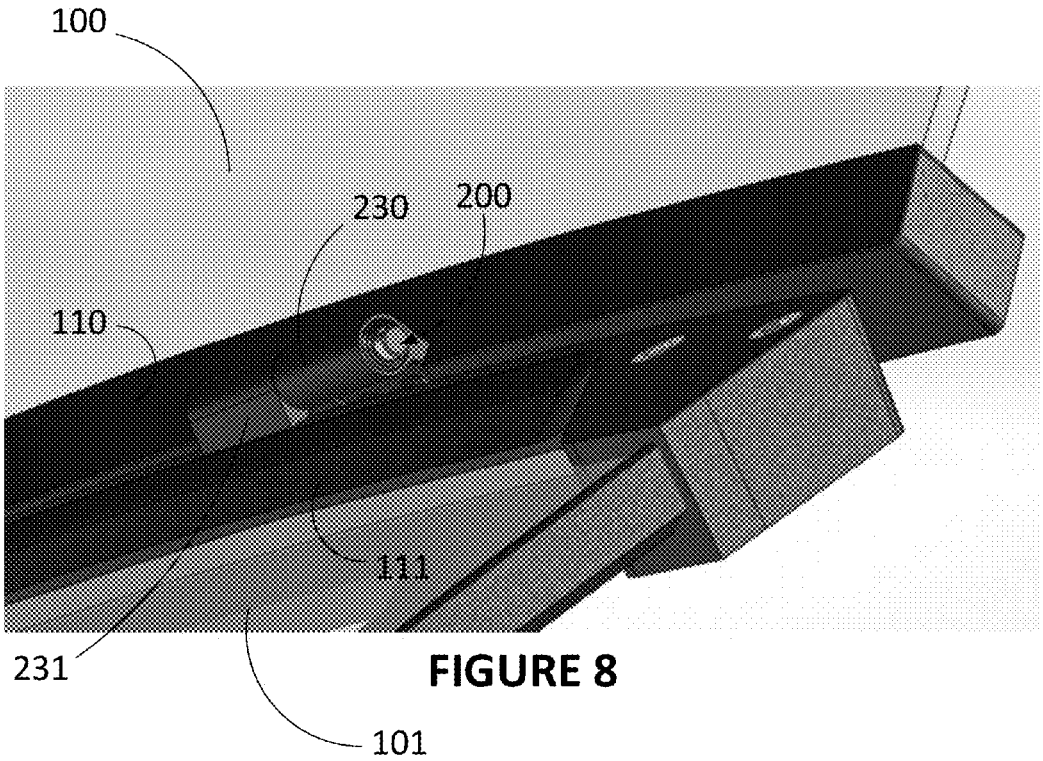
Figure 9:
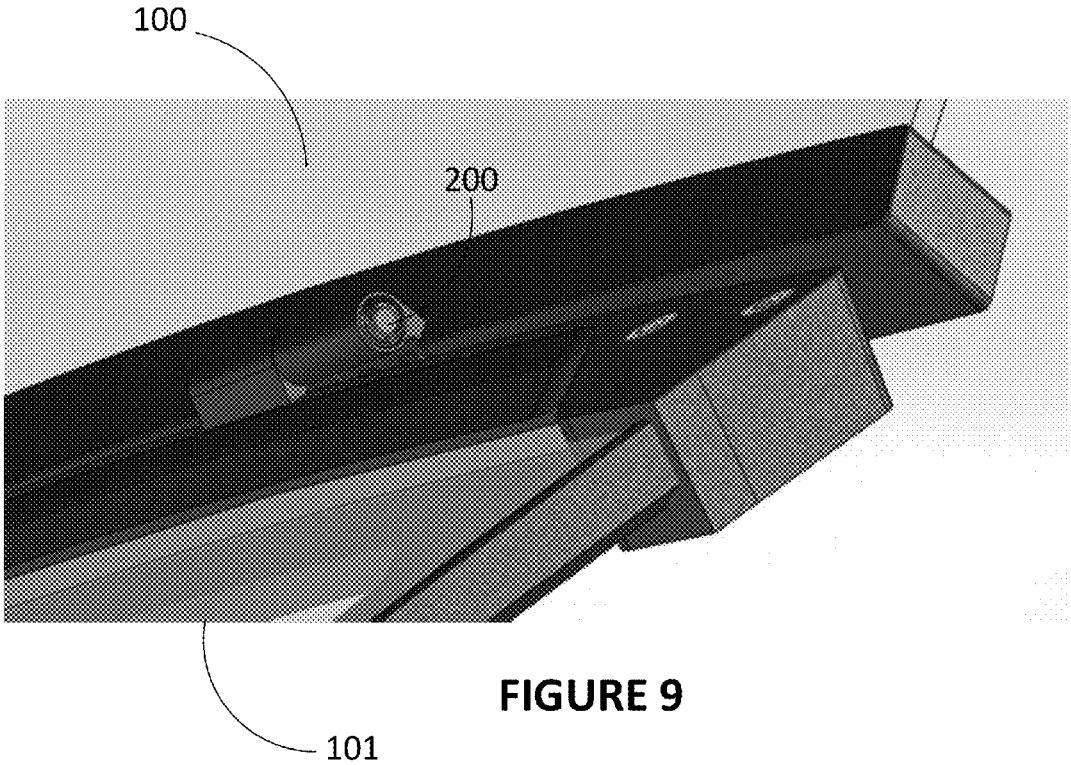

There is described a hinge for detachably connecting a door or window to a wall or a frame such as a windshield. The hinge comprising a shaft extending longitudinally, further comprising a blocker which is extendable about the shaft. A first socketed member is fixed to the shaft, and a second socketed member comprises a lumen for sliding the shaft therein. The lumen comprises a cavity larger than a remainder of the lumen and which defines an inward edge on which the blocker abuts, thereby retaining the shaft in the lumen. The shaft comprises an inner recess which can house the blocker therein if the inner recess is aligned with the blocker, thereby retracting the blocker from the cavity and releasing the shaft from the second socketed member and allowing the first socketed member and the second socketed member to be separated. This can be useful for detaching a door of a boat windshield, for example.

In an embodiment, there is described a door assembly system, or more precisely a hinge to be fastened to a door and a wall/frame, which allows for safely and easily removing the door from the wall and storing it away while being able to easily re-install it when needed.

There is described a hinge 200 between a first panel 100 and a second panel 101. The first panel 100 forms a door that opens to an open position and closes to a closed position. The second panel 101 forms a wall (usually stationary) to which the first panel 100 (i.e., the door) is hingedly attached.

FIGS. 1-9 are various views which illustrate the first panel 100, or door, connected to the second panel 101, or wall, by the hinge 200. The door can be closed or opened with respect to the wall using the hinge 200, which allows the expected rotation movement to take place. FIGS. 1-9 show the glass door belonging to a boat windshield, as this is an environment in which door removability is a particularly advantageous feature. However, it should be understood that the hinge 200 described herein can be used with panels 100, 101 of various types, not limited to boat windshields. The hinge 200 can be used on glass windows and doors of buildings of any kind or for other transportation means for which a door can be provided (for example, trucks, vans, RVs, mobile homes, etc.). More generally, the hinge 200 can be used with glass frames for any purpose, where one of the frames, namely the door, can benefit from being removed. Therefore, empty panels, i.e., frames, can be used with the hinge 200.

There may also be provided a wall 103, shown in FIGS. 4-5 and 14-23, to which the door is not hingedly connected, but simply is adjacent to the edge of the door which is distal from the hinge connection. The door may abut on this wall 103 when it is closed.

According to an embodiment, the first panel 100 comprises a frame 110, which is a rigid frame that holds, or can hold, a glass panel 120.

According to another embodiment, the second panel 101 also comprises a frame 111, which is a rigid frame that holds a glass panel 121.

The hinge 200 is provided between both frames 110, 111. Each one of these frames 110, 111 is therefore allowed to rotate with respect to the other one, the axis of rotation being defined by the hinge 200 which usually allows rotation of the frames 110, 111 only with respect to the axis it defines.

In a non-limiting example of implementation, the door assembly 101 is part of a boat windshield. In yet another embodiment, the boat windshield comprises two stationary panels 101 and 103 and the removable door 102. In an embodiment, the removable door 102 is provided in the middle between the two stationary panels 101 and 103.

As shown in FIGS. 10-13, the hinge 200 is detachable. This detachability enables the complete detachment, or removal, of the first panel 100, or door, from the second panel 101, or wall, to which the door is hingedly attached when it is not completely detached therefrom.

The hinge 200 basically comprises two parts that are fastened to different panels and are allowed to rotate around the axis defined by the hinge. These parts that are fastened to the different panels can be defined as hinge frames 210, 211. The hinge axis (longitudinal axis, or rotation axis) is defined by a shaft 220 extending longitudinally inside the hinge 200. Both hinge frames 210, 211 are only allowed to rotate with respect to the longitudinal axis of the shaft 220. In order to keep the hinge frames 210, 211 attached to the hinge 200 so they can hinge around it, both hinge frames 210, 211 comprise a socketed member 230, 231. The socketed members 230, 231, have a hollow cylindrical shape forming a socket or bore that partially surrounds or encloses the shaft 220 along a part of its length. The shaft 220 has therefore a part thereof that is housed within the socket or bore defined within the lumen of the socketed members 230, 231. The socketed members 230, 231 allows the rotation movement of the hinge frames 210, 211 around the shaft 220. However, since they rigidly enclose the shaft 220, the socketed members 230, 231 ensure that the hinge frames 210, 211 cannot move away (i.e., translate outwardly) from the shaft 220; in other words, they remain attached to the shaft 220 while allowing hinge-type rotation.

Now referring to FIGS. 10-13, there is described how the hinge 200 can be unlocked and detached to enable easy and complete removal of the door from the wall to which it is normally hingedly attached.

Figure 10:
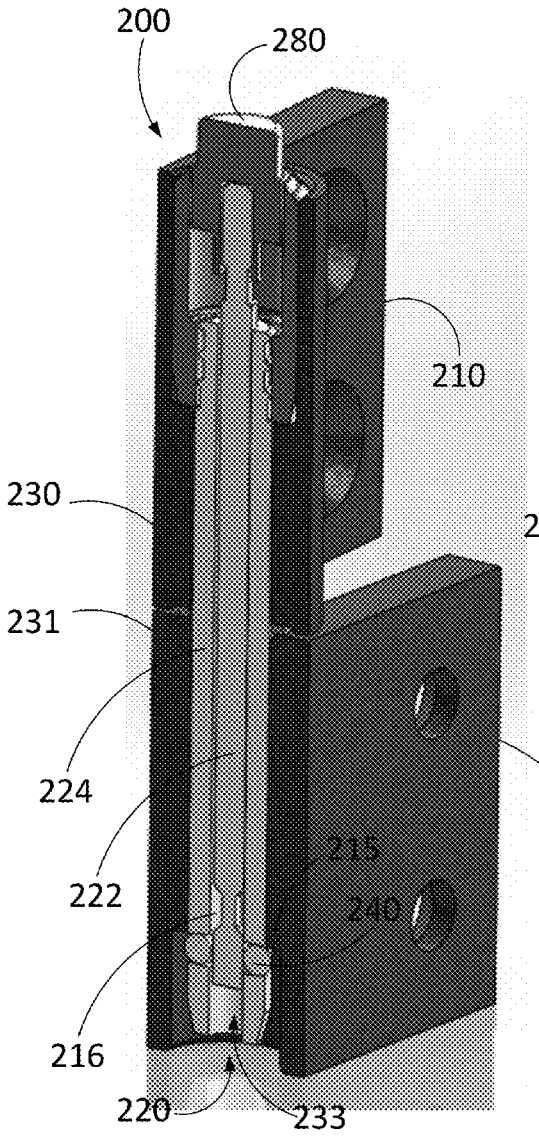
FIG. 10 is a cross-section illustrating the hinge in a locking position, according to an embodiment.
Figure 11:
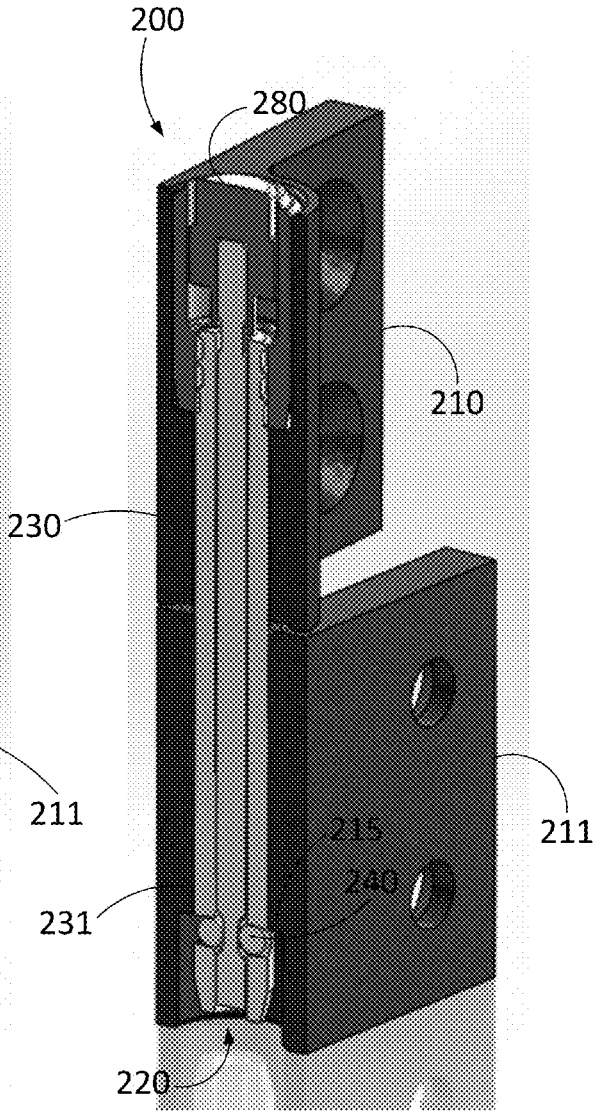
FIG. 11 is a cross-section illustrating the hinge in an unlocking position, according to an embodiment.

According to an embodiment, as shown in FIGS. 10-11, the shaft 220 is a two-part shaft. The shaft 220 comprises a core 222 and a jacket 224 surrounding the core 222. The core 222 is an elongated rod that extends longitudinally like the shaft 220; however its diameter is smaller than that of the shaft 220. The jacket 224 is a hollow cylinder extending longitudinally like the shaft 220; its outside diameter defines the outside diameter of the shaft 220, and its inner diameter is at least slightly larger than that of the core 222 so the core 222 can be housed therein to enable movement of the core 222 within the jacket 224 and movement of the jacket 224 within the shaft 220.

According to an embodiment, the shaft 220 is fastened to only one of the socketed members 230, 231. For example, as shown in FIG. 10, the jacket 224 can be fastened, substantially permanently, to the lumen surface inside the first socketed member 230. In FIG. 10, the jacket 224 has a thread cooperating with another thread inside the first socketed member 230, so that the shaft 220 can be screwed into the first socketed member 230 and remain attached thereto substantially permanently, i.e., until someone unscrew these parts for dismantling the system.

The shaft 220 is not attached to the other (second) socketed member 231. It means that the shaft 220 can translate longitudinally within a bore 233, or socket, defined within the second socketed member 231, while the longitudinal translation of the shaft 220 within the first socketed member 230 is made impossible by the fact it is attached thereto.

As shown in FIGS. 10-11, there is provided a stopper or blocker 240 at the periphery of the shaft 220. In normal circumstances, the blocker 240 extends away from the core to provide a diameter larger than the jacket 224 (i.e., the blocker 240 is in a locking position). The outside of the jacket 224 and the inside of the bore 233 form an interface through which the blocker 240 normally protrudes. Having the blocker 240 protrude from the jacket 224 in which it is housed blocks the longitudinal translation movement between the shaft 220 and the second socketed member 231. In complement to this blocker 240, there is provided a cavity about the bore 233 inside the second socketed member 231 (to which the shaft 220 is not permanently attached). Whereas the bore 233 defines a lumen with an inner diameter (i.e., inside the bore 233) which is slightly larger than the jacket 224, but smaller than the diameter defined by the blocker 240, the cavity is larger than the jacket 224 and also larger than the diameter defined by the blocker 240. This cavity on the bore 233 is defined at its upper end by an inward edge 215 on which the blocker 240 may abut. Therefore, when the blocker 240 is in its locking position, it is larger than the inner diameter of the lumen inside the inward edge 215 and therefore the blocker 240 abuts on the inward edge 215. A tentative longitudinal upward movement of the jacket with respect to the second socketed member 231 would fail (i.e., such a tentative movement would be prevented) because the blocker 240, when abutting on the inward edge 215 as it is in locking position, would retain the shaft 220 therein. The blocker 240 and the inward edge 215 act together as a retainer for the shaft 220 within the second socketed member 231. Therefore, if the blocker 240 occupies a volume in both the cavity on the bore 233 and the recess 216, the longitudinal translation movement is blocked. To unlock the hinge 200, the blocker 240 needs to be brought only into the recess 216 in the jacket 224 (as shown) without overlapping into the cavity defined on the surface of the bore 233.

According to an embodiment, the core 222 can translate longitudinally, up to a limit of translation, inside the jacket 224. As described below, this longitudinal translation of the core 222 inside the jacket 224 is used to unlock the hinge 200 so it can be detached.

Indeed, the blocker 240 is larger than the jacket 224 when it is in a locking position so that it can abut on the inward edge 215 and prevent longitudinal translation (that would eventually result in detachment of the panels 100, 101), as shown in FIG. 10 which illustrates the hinge 200 in locking position. However, the blocker 240 is movable to an unlocking position, illustrated in FIG. 11, in which the width or diameter occupied by the blocker 240 is no larger than that of the jacket 224 (i.e., it has the same width or diameter, or a smaller width or diameter). In this situation, the blocker 240 is brought toward the core 222 and does not protrude through the interface between the outside of the jacket 224 and the inside of the bore 233. This has the effect of freeing the blocker 240 from the inward edge 215 on which it is abutting when in locking position, which implies that the shaft 220 is not retained anymore and can freely translate with respect to the second socketed member 231. Sliding can occur at the interface between the outside of the jacket 224 and the inside of the bore 233. If the shaft 220 is pulled upwardly, it separates from the second socketed member 231 by sliding out of the bore 233.

As shown in FIGS. 10-11, to reach the unlocking, the blocker 240 should be provided with enough space to physically retract inwardly so its diameter can decrease, and a force should also be provided to bring the blocker 240 in this space and cause it to retract.

As shown in FIG. 10, the blocker 240 is provided as a disc, ball, cylinder, rod, pin or any other similar item, and can comprise a plurality of blockers, e.g., two blockers. In the embodiment shown in FIG. 10, spaces are provided in opposing locations of the jacket 224 close to the bottom of the hinge 200. The blocker 240, regardless of its shape (ball, cylinder, etc.), is housed in this space on the jacket 224, and abuts on the surface of the core 222 inside the jacket 224, as shown in FIG. 10.

According to an embodiment, cavities or recesses 216 are provided on the core 222, as shown in FIG. 10, where the recess is defined by an inwardly tapered portion of the core 222 where the diameter of the core is reduced, in this case gradually reduced, to form a thinner portion of the core 222. The depth of the recess 216 should be sufficient to allow the blocker 240 to be completely housed within the jacket surface and stop protruding through this surface outside the jacket. Sliding the core 222 within the jacket 224 results in translation of the recess 216. If the core 222 is translated significantly, the recesses can be moved to the location of the blocker 240 abutting inwardly on the core 222, as shown in FIG. 11. The sudden presence of the recesses 216 on the inward side of the blocker 240 makes the blocker 240 retract into the recesses 216.

For this retraction to take place, some force can be provided to urge the parts of the blocker 240 inwardly. For example, both discs or balls cylinders forming the blocker 240 can be magnetized in order to be attracted one toward the other and therefore be urged naturally into the recesses 216 to fill them if the recesses happen to be vis-à-vis the blocker 240. Other types of forces can be contemplated, such as a spring force provided from outward inwardly from springs housed in the second socketed member 231, or a spring linking both parts of the blocker 240 together, with a longitudinal channel defined inside the core to let this spring pass therethrough. A resilient material such as a resilient pad located outwardly with respect to the blockers 240 can also be contemplated. Alternatively, there can be no force to urge the blocker 240 inwardly; upon the pulling up of the shaft 220, if the blocker 240 is free to move into the recess 216, its rounded shape will force the blocker 240 to rotate and move into the recess 216, thereby unlocking the shaft 220 from the second socketed member 231.

In order to change from the locking position to the unlocking position of the hinge 200, a user may have to push on a button 280 at the top of the shaft 220, housed at the top end of the first socketed member 230. The core 222 extends longer upwardly than the jacket 224 (i.e., it is partly extruded therefrom) and the top end of the core 222 is fitted into the button 280, as shown in FIG. 10, to which it is fixedly secured. By pressing on the button downwardly, the core 222 is longitudinally translated downwardly by sliding inside the jacket 224 (which is not mobile with respect to the first socketed member 230 as it is secured thereto). This action brings the recesses 216 of the core 222 at the same height as the blockers 240, which can then engage thereinto, and therefore the hinge 200 is brought to its unlocking position, as shown in FIG. 11.

According to an embodiment, right below the button 280, around the extruded portion of the core 222 and above the top end of the jacket 224, there is provided an enclosed space, shown in FIGS. 10-11. Optionally, this space can advantageously be provided with a spring loaded in compression or any other similar biasing means to push on the button 280 upwardly in such a way that when no one is pressing the button 280, the button 280 is kept upward so that the hinge 200 is by default in locking position.

Figure 12:
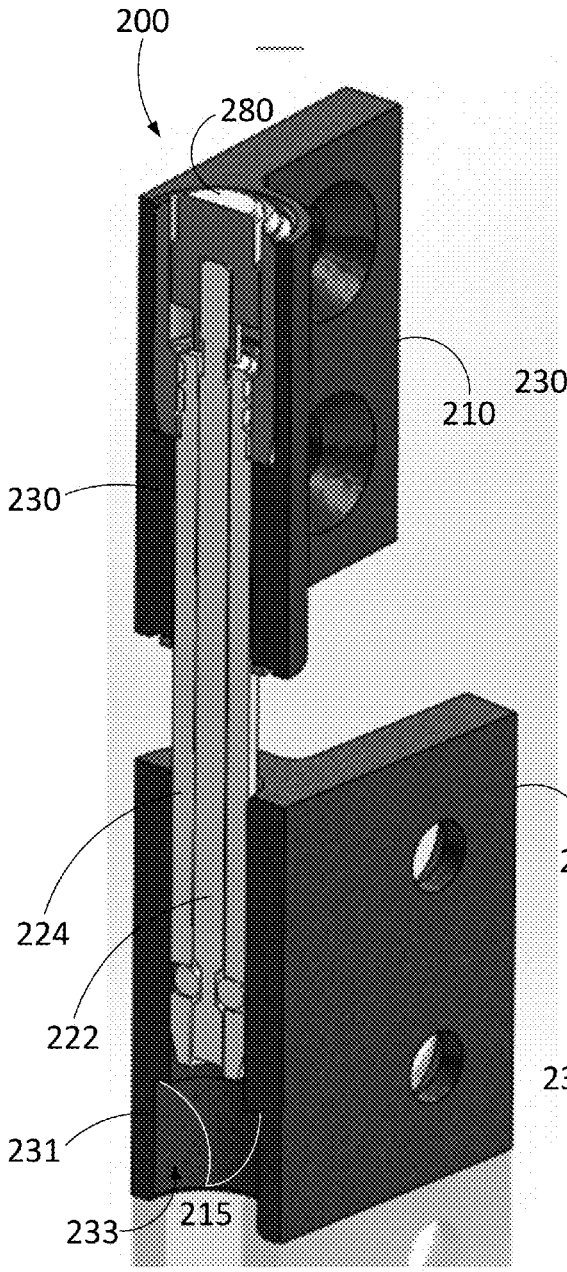
FIG. 12 is a cross-section illustrating the hinge being separated, according to an embodiment.
Figure 13:
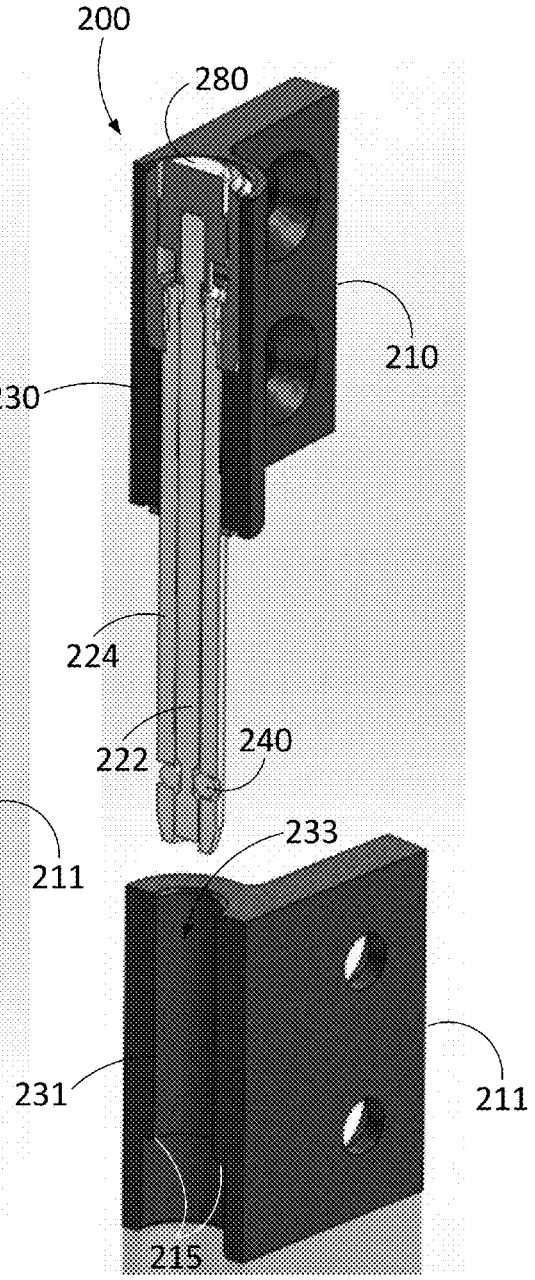
FIG. 13 is a cross-section illustrating the separated hinge, according to an embodiment.
Figure 14:
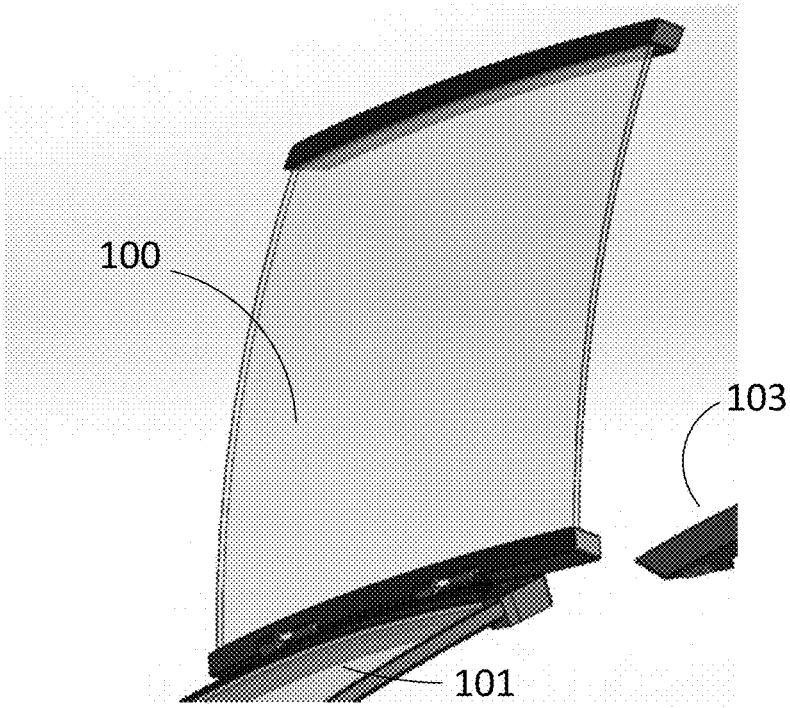
FIG. 14 is a perspective view illustrating the door being detached from the wall while the hinge is being separated, according to an embodiment.
Figure 15:
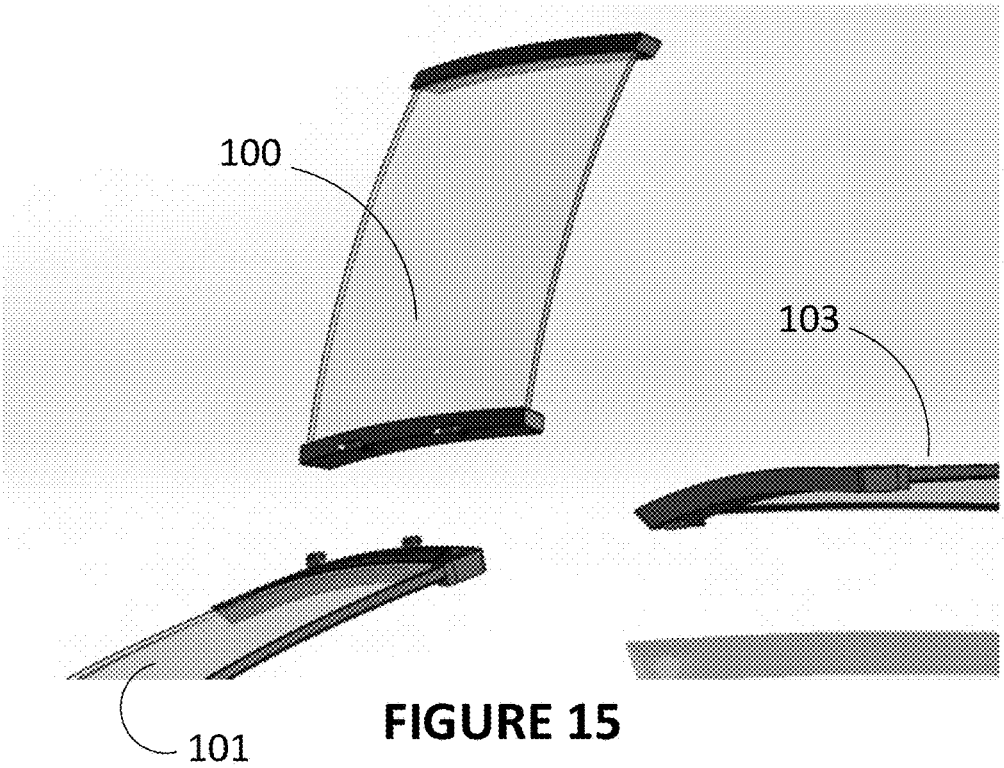
FIG. 15 is a perspective view illustrating the door detached from the wall with the hinge separated, according to an embodiment.
Figure 16:
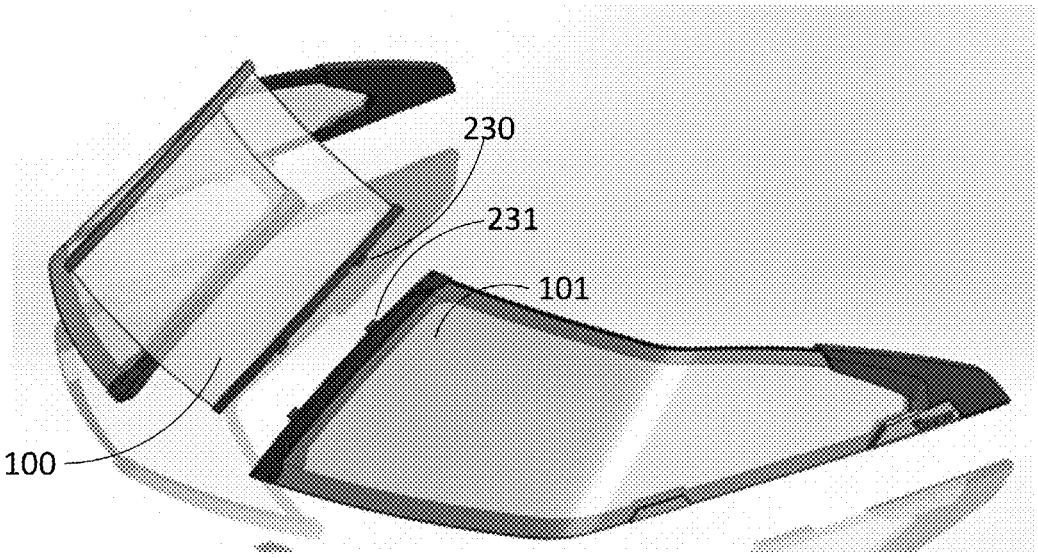
FIG. 16 is another perspective view illustrating the door detached from the wall with the hinge separated, according to an embodiment.
Figure 17:
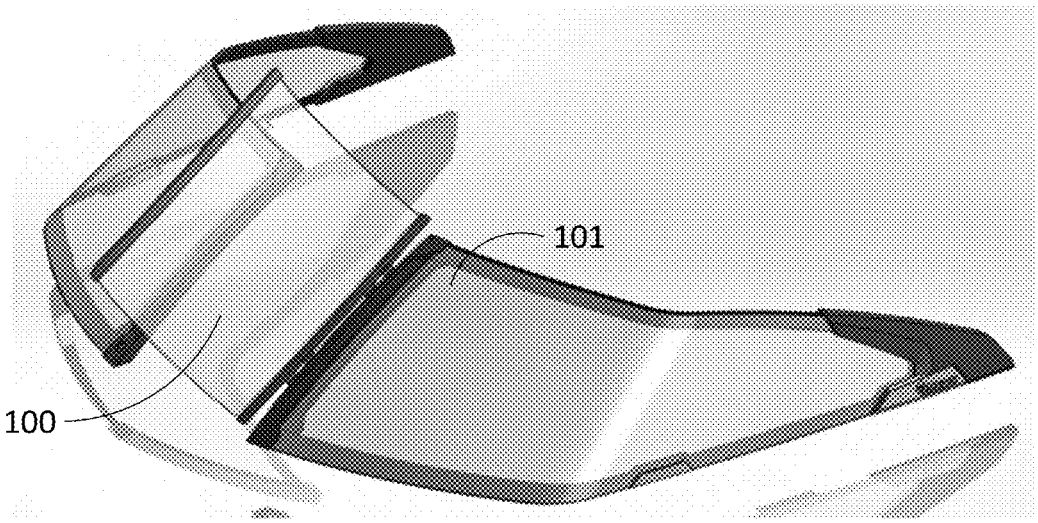
FIG. 17 is a perspective view illustrating the door being reattached to the wall with the hinge being reunited, according to an embodiment.
Figure 18:
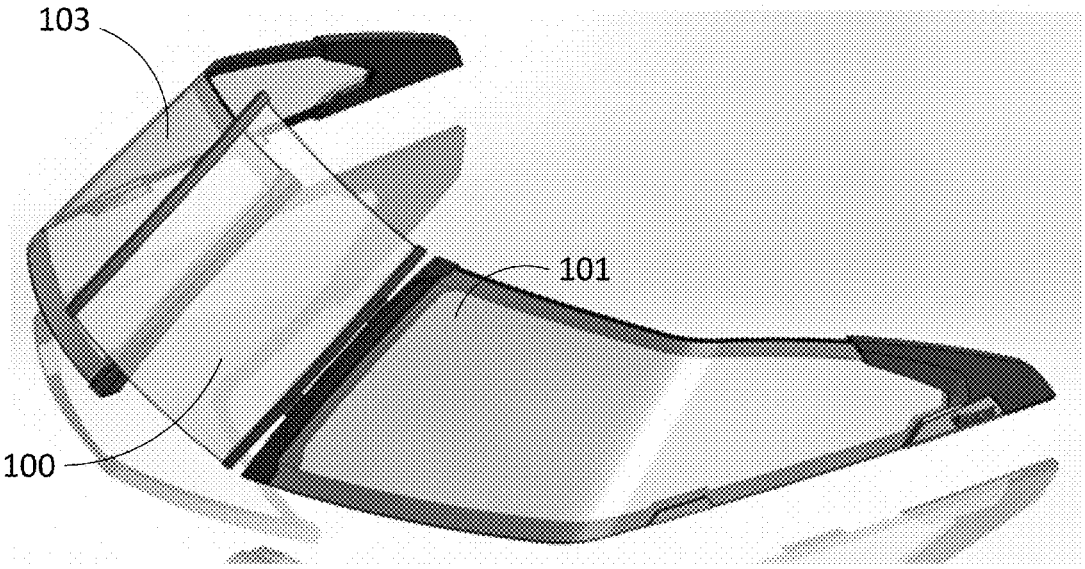
FIG. 18 is a perspective view illustrating the door reattached to the wall with the hinge reunited, according to an embodiment.
Figure 19:
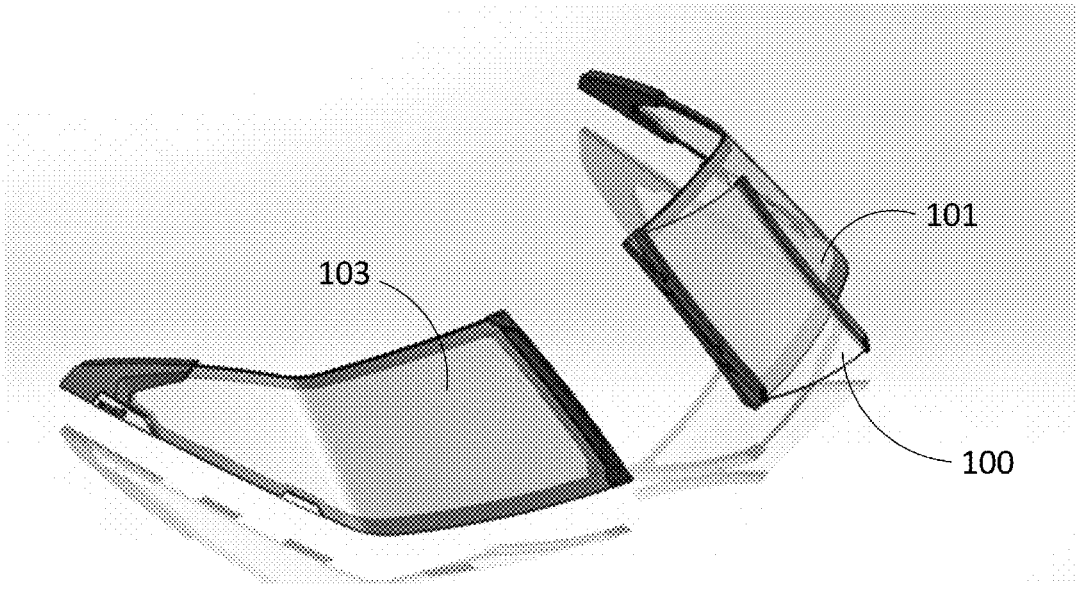
FIGS. 19-20 are perspective views illustrating the opened door hingedly connected to the wall, according to an embodiment.
Figure 20:
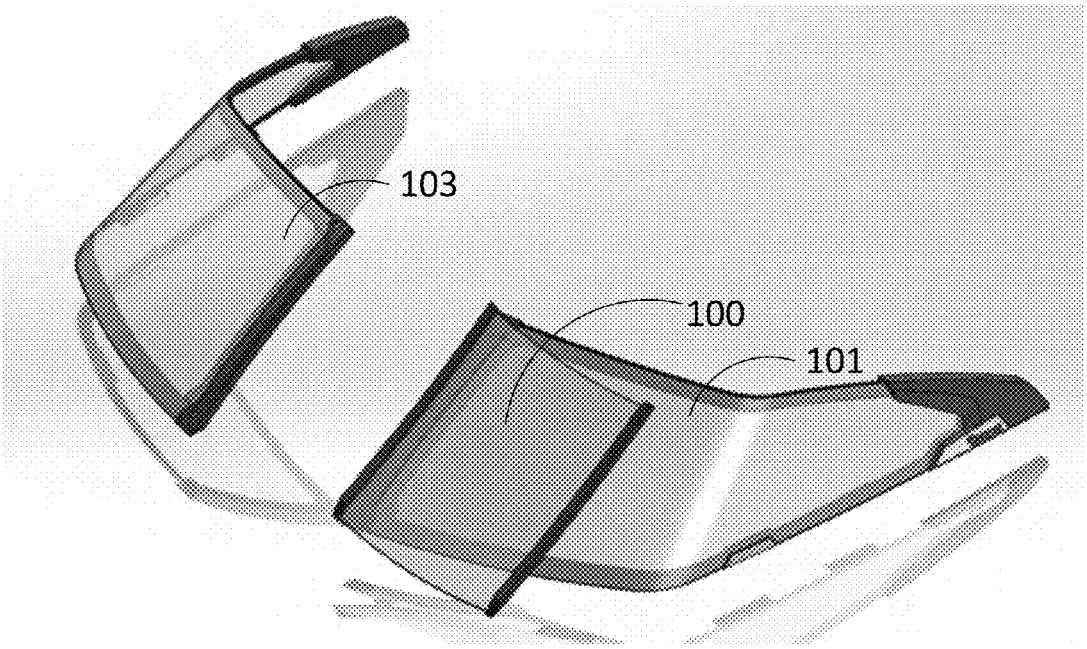

As mentioned above, when the hinge 200 is in unlocking position, the shaft 220 is not retained anymore in the second shaft surround portion 231. If a user pulls the first socketed member 230 upwardly, the shaft 220 can completely slide upwardly out of the second socketed member 231, thereby separating the first socketed member 230 from the second socketed member 231, as shown in FIGS. 12-13. In practice, the first socketed member 230 is usually fastened to the first panel 100 or door, and the second socketed member 231 is usually fastened to the second panel 101 or wall. The user is therefore expected to pull the door upwardly to perform the separation, thereby detaching the door from the wall. Doing this requires that the user push on the button 280 to unlock the hinge 200 at the start of the pulling movement, thereby also locking the button 280 in its downward position. After having started pulling the door upwardly, the user may release the button 280 since after having pulled the shaft 220 upwardly, the hinge 200 is effectively unlocked and the shaft 220 may slide freely within the second socketed member 231, as shown in FIG. 12, thereby also retaining the button 280 in its lowermost position with respect to the first socketed member 230. FIGS. 14-16 illustrate a door being detached from the wall, with the hinge 200 being separated into two separate structures.

If the user needs to put the door back in place, the user needs to first insert the bottom end of the shaft 220 into the top end of the bore 233 in the second socketed member 231 and slide the shaft 220 downwardly thereinto. When the shaft 220 reaches the bottom of the second socketed member 231, the blocker 240 has space to expand into the cavities defined within a lower portion of the bore 233 to reach the locking position and, assuming the user is not pushing on the button 280, the hinge 200 will come back to its locking position. The button 280 will thereby unlock and is free to take back its default position by moving upwardly so it can eventually be pressed again. FIGS. 16-19 illustrate a door being put back in place (i.e., reattached to the wall), with the hinge 200 being reunited into the original single structure.

The first and second socketed members 230, 231 are respectively fastened to the door and to the wall, or they are respectively fastened to the wall and to the door. The first case is preferable so that the opening made free by the removal of the door is not encumbered by the shaft 220 remaining at the edge of that opening (i.e., the shaft 220 is kept with the door which is removed and put away somewhere else, thereby not bothering anyone).

The fastening of the socketed members 230, 231 can be temporary or permanent, and can be of various types, for example, without limitation: screwing, bolting, gluing, soldering, etc. The socketed members 230, 231 can also be parts of the frames 110, 111 of the panels 100, 101, belonging integrally to these elements by being molded, machined or carved to extend therefrom.

Furthermore, as shown in FIGS. 1, 4-5, 7, 14-23, there can be more than one hinge 200 on a frame 110, 111, for example two hinges 200, which both work in substantially the same way. The socketed members 230, 231 should be located at corresponding locations on the different frames 110, 111 so they can connect together and form the hinge 200 when both panels are put together.

Figure 21:
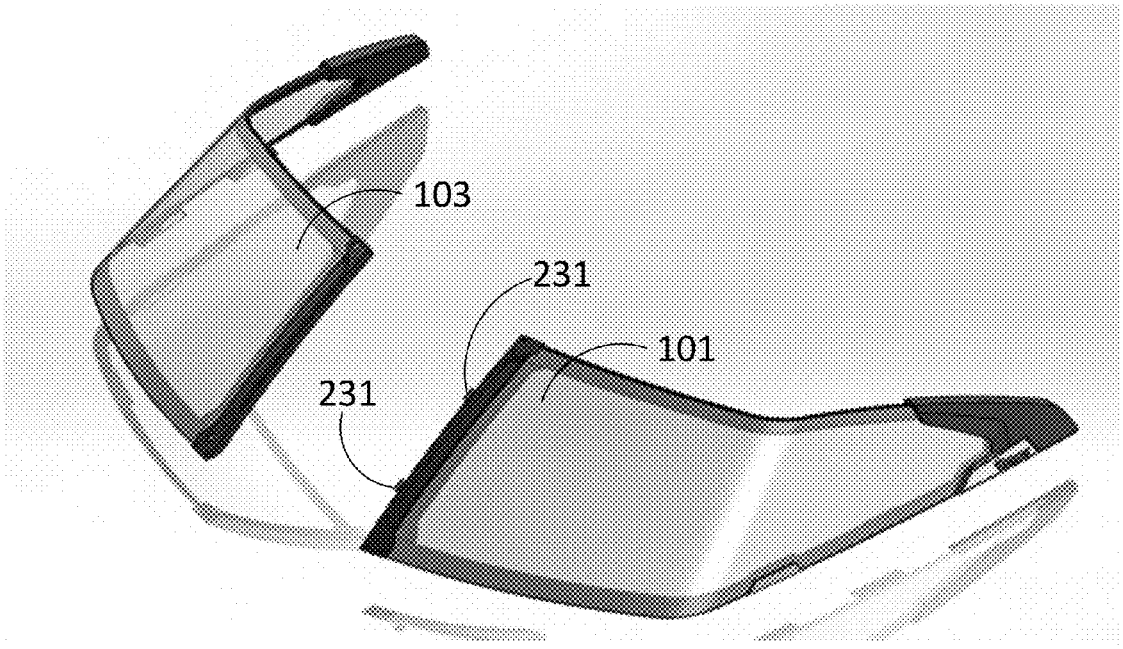
FIGS. 21-23 are perspective views illustrating the wall of the windshield with the door removed, according to an embodiment.
Figure 22:
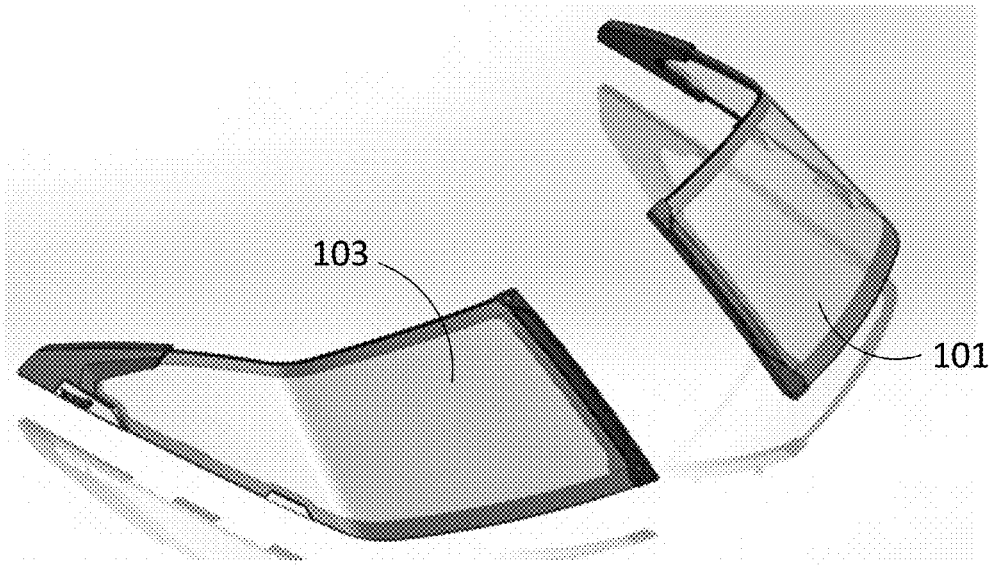
Figure 23:
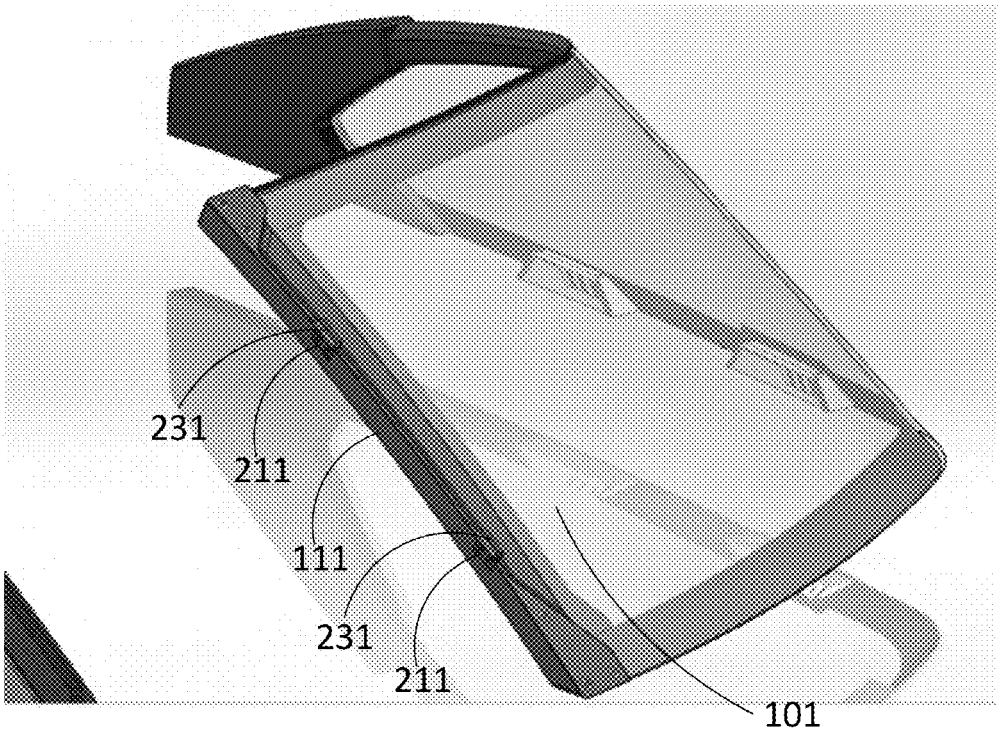

The hinge 200 described above is advantageous since it allows the door to be removed from the surrounding wall(s), as shown in exemplary FIGS. 21-23, where the door is removed from the windshield to which it belongs. The passage is free of any encumbering structure. Since the door is removed, it does not need to be locked in a completely opened position such as the one illustrated in FIG. 20 where, if the door was to be locked as illustrated, the glass of the windshield would be doubled at the location of the opened door, thereby reducing visibility. Having the door locked in this position can also result in flapping or wobbling of the door. Removing the door, as permitted by the hinge 200, avoids these problems.

Figure 24:
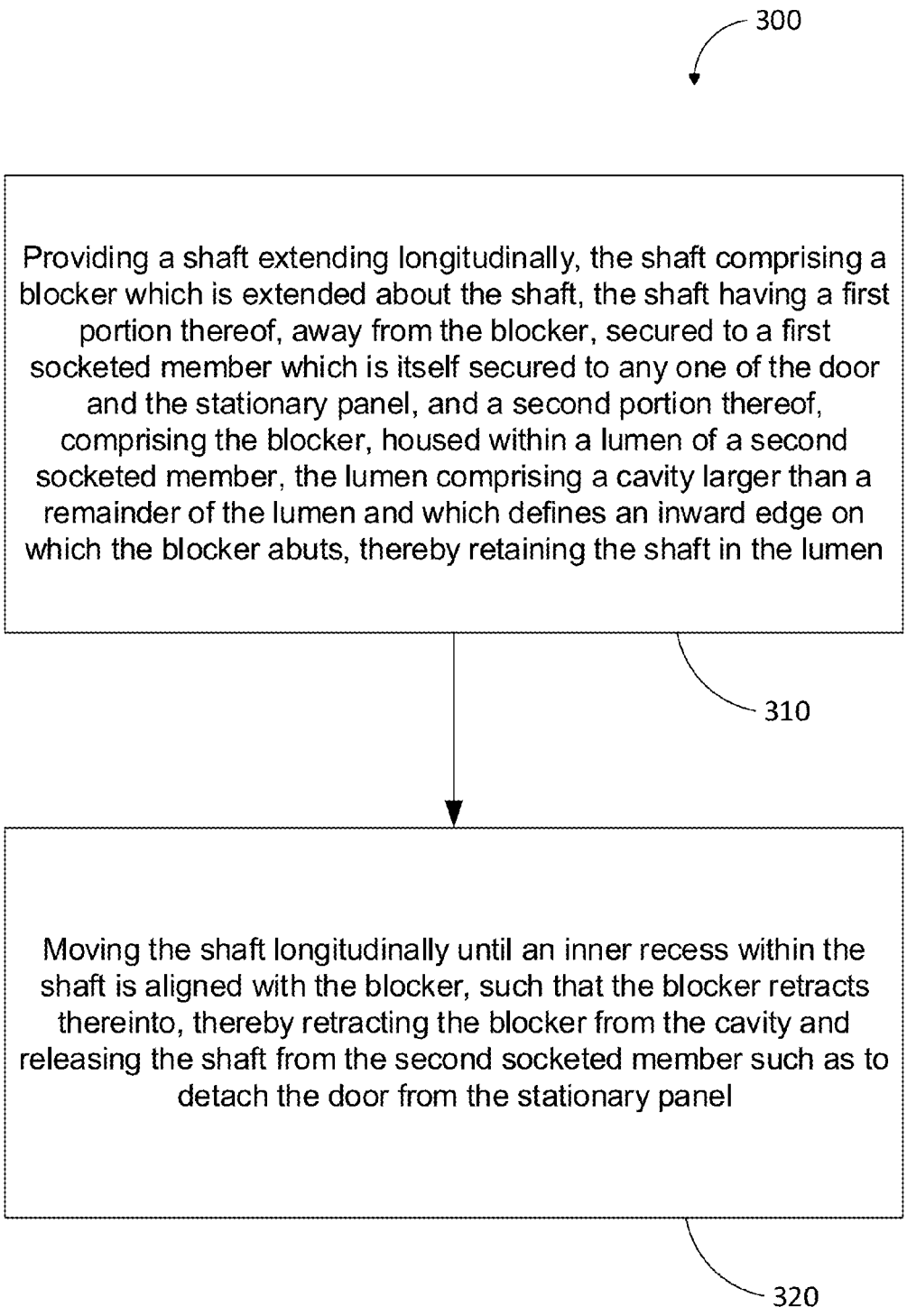
FIG. 24 is flowchart for a method of detaching a hinged door, in accordance with an embodiment.

FIG. 24 is a flowchart for a method 300 for detaching a hinged door that is both hingeable and removable with respect to a stationary panel, in accordance with an embodiment. The method 300 begins at step 310 by providing a shaft extending longitudinally, the shaft comprising a blocker which is extended about the shaft, the shaft having a first portion thereof, away from the blocker, secured to a first socketed member which is itself secured to any one of the door and the stationary panel, and a second portion thereof, comprising the blocker, housed within a lumen of a second socketed member, the lumen comprising a cavity larger than a remainder of the lumen and which defines an inward edge on which the blocker abuts, thereby retaining the shaft in the lumen. Step 320 comprises moving the shaft longitudinally until an inner recess within the shaft is aligned with the blocker, such that the blocker retracts thereinto, thereby retracting the blocker from the cavity and releasing the shaft from the second socketed member such as to detach the door from the stationary panel.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A boat windshield comprising:

a first stationary panel;

a removable door, the removable door together with the first stationary panel forming at least a portion of the boat windshield; and a hinge making the removable door hingeable with respect to the first stationary panel, the hinge comprising:

a first socketed member fixed to any one of the first stationary panel and the removable door, and a second socketed member fixed to another one of the first stationary panel and the removable door; and a shaft extending longitudinally, fixed to the first socketed member and slidable into the second socketed member, further comprising a blocker which is extendable about the shaft to act as a longitudinal lock of the shaft in the second socketed member.

2. The boat windshield of claim 1, further comprising a second stationary panel, the removable door being provided between the first stationary panel and the second stationary panel and having an edge flush with the second stationary panel to have the first and second stationary panels and the removable door together form at least a portion of the boat windshield.

3. The boat windshield of claim 2, wherein the first and second stationary panels and the removable door are transparent panels.

4. The boat windshield of claim 1, wherein the second socketed member comprises a lumen for sliding the shaft therein, the lumen comprising a cavity larger than a remainder of the lumen and which defines an inward edge on which the blocker abuts, thereby retaining the shaft in the lumen.

5. The boat windshield of claim 4, wherein the shaft comprises an inner recess which can house the blocker therein if the inner recess is aligned with the blocker, thereby retracting the blocker from the cavity and releasing the shaft from the second socketed member.

6. The boat windshield of claim 5, wherein the shaft comprises a core and a jacket around the core which is slidable with respect to the core, both extending longitudinally, further comprising a blocker which is extendable about the shaft and housed in the jacket.

7. The boat windshield of claim 6, further comprising a button to which the core is secured, the button being pushable by a user to slide the core with respect to the jacket.

8. The boat windshield of claim 7, further comprising a biasing means to urge the button back to an original position when the button is not being pushed by a user.

9. The boat windshield of claim 7, wherein the core has a recess therein which, upon sliding the core with respect to the jacket, reaches a location where the blocker is housed in the jacket, the blocker retracting into the recess, thereby moving the blocker away from the inward edge, releasing the shaft from the second socketed member and allowing the first socketed member and the second socketed member to be separated.

10. The boat windshield of claim 9, wherein the recess if formed on a surface of the core by an inwardly tapered shape of the core.

11. A hinge for making a door hingeable and removable with respect to a stationary panel, the hinge comprising:

a shaft extending longitudinally, further comprising a blocker which is extendable about the shaft;

a first socketed member fixed to the shaft; and a second socketed member comprising a lumen for sliding the shaft therein, the lumen comprising a cavity of a diameter larger than a remainder of the lumen and which defines an inward edge on which the blocker abuts, thereby retaining the shaft in the lumen, wherein the shaft comprising an inner recess which can house the blocker therein if the inner recess is aligned with the blocker, thereby retracting the blocker from the cavity and releasing the shaft from the second socketed member.

12. The hinge of claim 11, wherein the first socketed member is to be attached to the door and the second socketed member is to be attached to the stationary panel, the hinge providing hingeable movement between the door and the stationary panel, and removability of the door with respect to the stationary panel.

13. The hinge of claim 12, wherein the door and the stationary panel form at least a portion of a boat windshield.

14. A method of detaching a hinged door that is both hingeable and removable with respect to a stationary panel, the method comprising:

providing a shaft extending longitudinally, the shaft comprising a blocker which is extended about the shaft, the shaft having a first portion thereof, away from the blocker, secured to a first socketed member which is itself secured to any one of the door and the stationary panel, and a second portion thereof, comprising the blocker, housed within a lumen of a second socketed member, the lumen comprising a cavity larger than a remainder of the lumen and which defines an inward edge on which the blocker abuts, thereby retaining the shaft in the lumen; and moving the shaft longitudinally until an inner recess within the shaft is aligned with the blocker, such that the blocker retracts thereinto, thereby retracting the blocker from the cavity and releasing the shaft from the second socketed member to detach the door from the stationary panel.

15. The method of claim 14, wherein the door and the stationary panel form at least a portion of a boat windshield.

16. The method of claim 15, further comprising providing the door at a position by the stationary panel such that an edge of the door away from the stationary panel ends flush with a second stationary panel to form the boat windshield.

17. The method of claim 16, further comprising, upon releasing the shaft from the second socketed member, completely detaching the door from the stationary panel.

18. The method of claim 17, wherein moving the shaft longitudinally comprises pushing on a button at an end of the shaft to push the shaft longitudinally in a direction contrary to the end of the shaft.

19. The method of claim 18, wherein the shaft is secured to the first socketed member by a jacket of the shaft, wherein the shaft further comprises a core housed within the jacket, wherein moving the shaft longitudinally comprises moving the core longitudinally with respect to the jacket.

20. The method of claim 19, wherein the inner recess is provided on a surface of the core, wherein upon moving the shaft longitudinally, the core has its inner recess aligned with the blocker to allow the blocker to retract thereinto.

21. The method of claim 20, further comprising urging the button back to an original position using a biasing means when the button is not being pushed by a user.

* * * * *